US010526175B2

(12) United States Patent
Lindberg et al.

(10) Patent No.: US 10,526,175 B2
(45) Date of Patent: Jan. 7, 2020

(54) LOW-CONSTRUCTION TROLLEY FOR WIRE ROPE HOIST

(71) Applicant: KONECRANES GLOBAL CORPORATION, Hyvinkää (FI)

(72) Inventors: Teppo Lindberg, Nuppulinna (FI); Henri Kokko, Veikkola (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 427 days.

(21) Appl. No.: 15/113,361

(22) PCT Filed: Jan. 23, 2015

(86) PCT No.: PCT/FI2015/050040
§ 371 (c)(1),
(2) Date: Jul. 21, 2016

(87) PCT Pub. No.: WO2015/110706
PCT Pub. Date: Jul. 30, 2015

(65) Prior Publication Data

US 2017/0022032 A1 Jan. 26, 2017

(30) Foreign Application Priority Data

Jan. 24, 2014 (FI) ..... 20145071

(51) Int. Cl.
*B66C 11/06* (2006.01)
*B66D 1/12* (2006.01)
(Continued)

(52) U.S. Cl.
CPC ..... *B66C 11/06* (2013.01); *B66D 1/12* (2013.01); *B66D 1/14* (2013.01); *B66D 1/36* (2013.01); *B66C 19/00* (2013.01)

(58) Field of Classification Search
CPC ..... B66C 11/00; B66C 11/02; B66C 11/04; B66C 11/06; B66C 19/00; B66D 1/02;
(Continued)

(56) References Cited

U.S. PATENT DOCUMENTS 3,129,671 A * 4/1964 Vanderbeck ..... B61C 13/04 104/93
4,372,452 A * 2/1983 McCord ..... A61G 7/1015 105/153
(Continued)

FOREIGN PATENT DOCUMENTS

CN 101323417 A 12/2008
CN 102224098 A 10/2011
(Continued)

OTHER PUBLICATIONS

Machine Translation for DE 102004063709 B3 (Year: 2004).*

*Primary Examiner* — Michael R Mansen
*Assistant Examiner* — Juan J Campos, Jr.
(74) *Attorney, Agent, or Firm* — Birch, Stewart, Kolasch & Birch, LLP

(57) ABSTRACT

A low-construction hoist for a wire rope hoist is arranged to move along a lower flange of a horizontal beam or rail. The trolley includes a trolley frame; bearing wheels, which are fixed to the trolley body and arranged to move on the upper surface of the lower flange of the rail, a hoisting mechanism including a rope drum for a hoisting rope, a hoisting member in cooperation with the hoisting rope for hoisting a load, and a hoisting motor for driving the rope drum; whereby the rope drum is supported to a first side of the trolley frame so that the axle of the rope drum is parallel to the rail, and the hoisting member is arranged to move under the rail; whereby the hoisting rope is led from the rope drum to a fixing point in the trolley frame through at least a rope pulley arrangement of the hoisting member, whereby the fixing
(Continued)

point of the hoisting rope to the trolley frame is located in the longitudinal direction of the trolley outside the end of the rope drum, or outside the vertical plane which is transverse in relation to the rail or beam and passing through the end of the rope drum.

18 Claims, 11 Drawing Sheets

(51) Int. Cl.
*B66D 1/14* (2006.01)
*B66D 1/36* (2006.01)
*B66C 19/00* (2006.01)

(58) Field of Classification Search
CPC ... B66D 1/12; B66D 1/14; B66D 1/28; B66D 1/36
See application file for complete search history.

(56) References Cited

U.S. PATENT DOCUMENTS 5,074,423 A * 12/1991 Smith ..... B66C 9/14 212/337
5,461,985 A 10/1995 Gersemsky
5,711,228 A * 1/1998 Itzin ..... B61C 13/04 104/295
5,809,896 A * 9/1998 Gersemsky ..... B66C 7/02 104/107
6,153,992 A * 11/2000 Gersemsky ..... B66C 9/14 318/362
7,234,400 B2 6/2007 Winter et al.
2002/0170872 A1 * 11/2002 Kiviniitty ..... B66C 9/14 212/328
2005/0092201 A1 5/2005 Winter et al.
2011/0089129 A1 * 4/2011 Gouault ..... B61B 13/04 212/71
2012/0256145 A1 10/2012 Zhao et al.

FOREIGN PATENT DOCUMENTS

CN 202226549 U 5/2012
DE 10 2004 063 709 B3 7/2006
DE 10 2011 115 910 A1 4/2013
EP 0 620 179 B1 6/1998
GB 1158109 A 7/1969
GB 2 265 348 A 9/1993
WO WO 02/32800 A2 4/2002

* cited by examiner

LOW-CONSTRUCTION TROLLEY FOR WIRE ROPE HOIST

BACKGROUND OF THE INVENTION

A low-construction trolley for a wire rope hoist, arranged to travel along a lower flange of a horizontal beam or rail, whereby the trolley comprises a trolley frame; bearing wheels that are attached to the frame of the trolley and arranged to travel on the upper surface of the lower flange of the beam or rail, and at least some of which are driven wheels to move the trolley; a hoisting mechanism comprising a rope drum for a hoisting rope, a hoisting member in cooperation with the hoisting rope for hoisting a load, and a hoisting motor for driving the rope drum; whereby the rope drum is supported to a first side of the trolley frame so that the axle of the rope drum is parallel to the beam or rail, and the hoisting member is arranged to move under the beam or rail; whereby the hoisting rope is led from the rope drum to a fixing point in the trolley frame through at least a rope pulley arrangement of the hoisting member.

A low-construction trolley is a common, overhead trolley type for lightweight bridge cranes with one main support. The basic idea behind it is to save hall height by taking up as little space as possible in the vertical direction.

As a result of the external shape taking up little space, the heaviest parts of a trolley in prior art, that is, the hoisting mechanism and rope drum, are found on the same side of the main support (which is the same as the aforementioned beam of rail or comprises the aforementioned beam or rail). This causes imbalance on the opposite sides of the main support, which is typically compensated for by a counterweight on the opposite side of the main support and opposite to the hoisting mechanism. When examining the hoist in the vertical direction, the rope system and hoisting member of the hoisting rope are in such a case arranged in an area limited by the ends of the counterweight, hoisting mechanism, and rope drum, whereby the fastenings of the hoisting rope to the rope drum and the trolley frame are also located in this area. Due to this space problem, the fixing point of the hoisting rope to the trolley frame is found closer to the main support than the disengagement point of the hoisting rope from the drum. For example, in a 4-rope solution, the fixing point of a sheave, in such a case, is to be placed at the mean distance of the aforementioned fixing point and disengagement point from the main support on the opposite side of the main support for the hoisting member to move essentially in the vertical plane that runs through the main support and for the trolley to stay in balance. This asymmetry and long lever arms in relation to the main support cause, however, additional twisting of the rope system in relation to the vertical axis in a load hoisting and lowering situation, and consequently harmfully large bending moment and the resulting additional stress on the trolley, on the bearing wheels, for example, and thus additional stress also on the main support. Disproportional load may cause premature wear and tear on the bearing wheels and/or the guiding surfaces on the beam or rail that the main support potentially has, creating jerking movement for the trolley.

In addition, if the fixing of the hoisting rope to the rope drum is typically located on the side of the trolley where the fixing point of the hoisting rope to the trolley frame is also located, the portion of the rope system that leads to a fixed fixing point may hit the portion of the rope system coming from the rope drum when the hoisting member is being lowered, which may wear and damage the hoisting rope. In this solution, the rope base, that is, the projection of the rope system in the horizontal plane is reduced as the hoisting member is lowered, which at the same time decreases the geometric resistance of the hoisting member twisting.

The "asymmetric" rope system described above is also implemented in such trolleys where the counterweight is replaced with a suspended contact to the main support, that is, the lower surface of the lower flange of the horizontal beam or rail referred to in the above. The U.S. Pat. No. 7,234,400 B2 and EP 0 620 179 B1 serve as examples of this solution. In these, too, exactly the same problems are seen as in trolleys comprising a counterweight.

SUMMARY OF THE INVENTION

The object of the invention is to solve the problems described above. This object is achieved with a trolley according to the invention, which is mainly characterised by the fact that the fixing point of the hoisting rope to the trolley frame is located in the longitudinal direction of the trolley, respectively beam or rail, outside the end of the rope drum, or outside the vertical plane which is transverse in relation to the rail or beam and passing through the end of the rope drum.

Advantageously, the fixing point of the hoisting rope to the trolley frame is located in the longitudinal direction of the trolley, respectively beam or rail, at a distance from the end of the rope drum, or the vertical plane which is transverse in relation to the rail or beam and passing through the end of the rope drum. This distance may be 0-1.5 times the diameter of the rope drum, for example.

The aforementioned transferring of the fixing point of the hoisting rope to the outside of the vertical plane which is transverse in relation to the rope drum end or rail or beam and passing through the end easily enables the most advantageous solution that the fixing point of the hoisting rope to the trolley frame is at essentially the same vertical plane as the disengagement point of the hoisting rope from the rope drum, as seen in the line parallel to the axle of the rope drum and parallel to the rail, in particular when the hoisting rope is guided from the rope drum through a rope pulley arrangement of the hoisting member and through at least one sheave on at least one side of the trolley frame to a fixing point on the same side of the trolley as the rope drum. In other words, when seen from the above, the fixing point of the hoisting rope to the trolley frame is essentially in the same line as the inner side line of the rope drum or the disengagement point of the hoisting rope from the rope drum as examined in the aforementioned direction. At the same time, this also means that the fixing point of the hoisting rope to the trolley frame is at essentially the same distance from the rail as the disengagement point of the hoisting rope or the inner side line of the rope drum.

The solution according to the invention makes it possible to establish symmetrical positioning of the support points of the hoisting rope in relation to the main support whereby the twisting of the hoisting member and the load attached to it, described in the above, may be substantially reduced during a hoisting event. In addition, no danger exists at any stage of the hoist of the hoisting rope crossing, even if the fixing point of the hoisting rope to the rope drum were on the side of the rope drum end where the fixing point of the hoisting rope to the trolley frame is located at a chosen distance outside the end in question.

In the most advantageous case, however, the fixing point of the hoisting rope to the rope drum is located on the side of the rope drum end that is on the opposite side than the rope drum end or the vertical plane which is transverse in relation to the beam or rail and passing through it, and outside of which rope drum end or vertical plane and closer to which the fixing point of the hoisting rope to the trolley frame is located. In such a case, the hoisting rope unreeling out and downward of the rope drum travels, in the direction of the main support, further away from the fixing point of the rope to the frame, whereby at the same time the rope base of the rope system increases, which reduces the twisting risk of the hoisting member and the load secured to it. Similarly, as the hoisting member and load are being hoisted up, at their highest position the projections of the various parts of the rope system are essentially perpendicular to the main support and the rope drum, whereby the twisting of the lifting hook and the load secured to it is substantially reduced, and the twisting stress directed at the trolley and the beam or rail is decreased.

The solution according to the invention additionally allows the diameter of the rope drum to be increased and the rope drum shortened, which reduces the drifting of the hoisting rope in the direction of the main support, and consequently the twisting risk of the hoisting member and the load secured to it.

In addition, the rope drum may now be brought closer to the main support, because the need no longer exists to reserve space for the fixing of the hoisting rope between the main support and rope drum. Correspondingly, the sheave or sheaves may be brought closer to the main support. The trolley-internal bending moment is thus further reduced. The new fixing point of the hoisting rope to the trolley frame also leaves more space around this fixing point, which may be utilized for safety equipment such as overload protection, for example. From the viewpoint of space becoming free, it is also possible to build a hoist with more than four ropes, for example, a 6-rope or 8-rope hoist. This means that the same hoisting mechanism may be used to hoist larger loads by changing the rope system, only.

From the point of view of balancing and stressing the trolley, it is further advantageous that the hoisting motor is placed under the beam or rail and at least partly on a different side than the rope drum, in relation to the vertical plane passing through the contact lines of the bearing wheels on the rope drum side, touching the lower flange of the beam or rail, most advantageously at least partly on a different side in relation to the vertical plane passing through the centre of the beam or rail than the rope drum. A relatively heavy hoisting motor entirely replaces the counterweights and spring supports used earlier. This solution additionally enables the rope drum to be more freely placed in the longitudinal direction of the beam or rail of the main support and the trolley, whereby there are more options to secure the fixing point of the hoisting rope to the trolley frame, outside the rope drum end.

The hoisting motor may be placed so that its longitudinal centre line is parallel to the longitudinal direction of the beam or rail, in such a manner, for example, that the hoisting motor is essentially in the same vertical plane as the beam or rail, whereby the vertical plane passing through the middle of the beam or rail is passing essentially through the longitudinal centre line of the hoisting motor. It is additionally feasible to move the hoisting motor away or closer to the rope drum, in relation to the vertical plane referred to in the above, as far away as needed until the desired balance is reached, if this is possible taking into account the power transmission and the structure of the trolley otherwise. The hoisting motor may additionally be positioned sideways in relation to the beam or rail.

By such positioning of the hoisting motor, uniform enough a bearing contact of the bearing wheels is achieved at the flange of the supporting beam or rail, whereby the wear on the bearing wheels is even, and the trolley, and thus the hoist, travel without jerking both when unladen and when carrying a load. So, there will be no additional stress on the trolley frame, caused by imbalance, when a load is being lifted or lowered. Installing a hoist is easier than before and lifting it up during the installation process, for example, is safer as the additional mass caused by a counterweight is missing.

LIST OF FIGURES

The invention is now explained in closer detail with reference to the accompanying drawings, in which FIG. 1 shows a trolley according to the invention as seen from the front and the direction of the rail supporting it;

Figure 1:
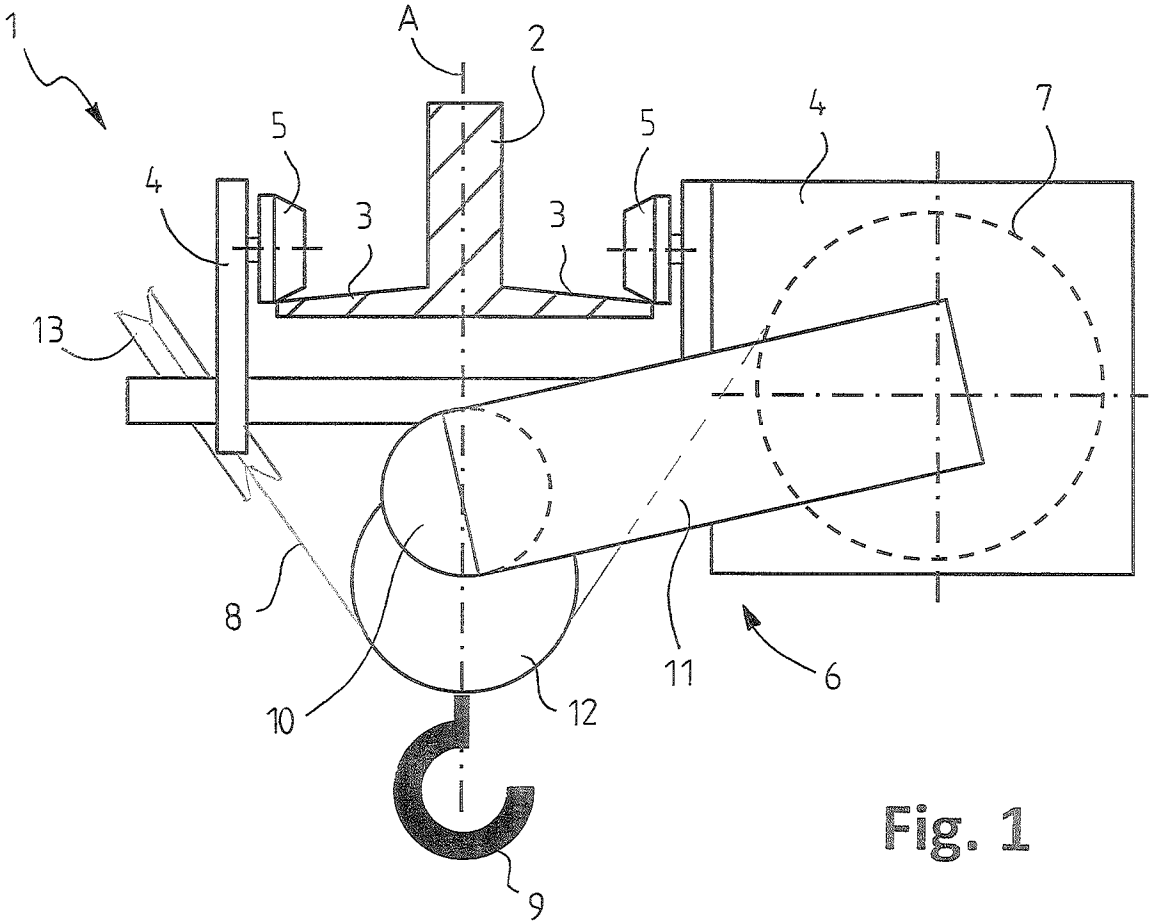
Figure 2:
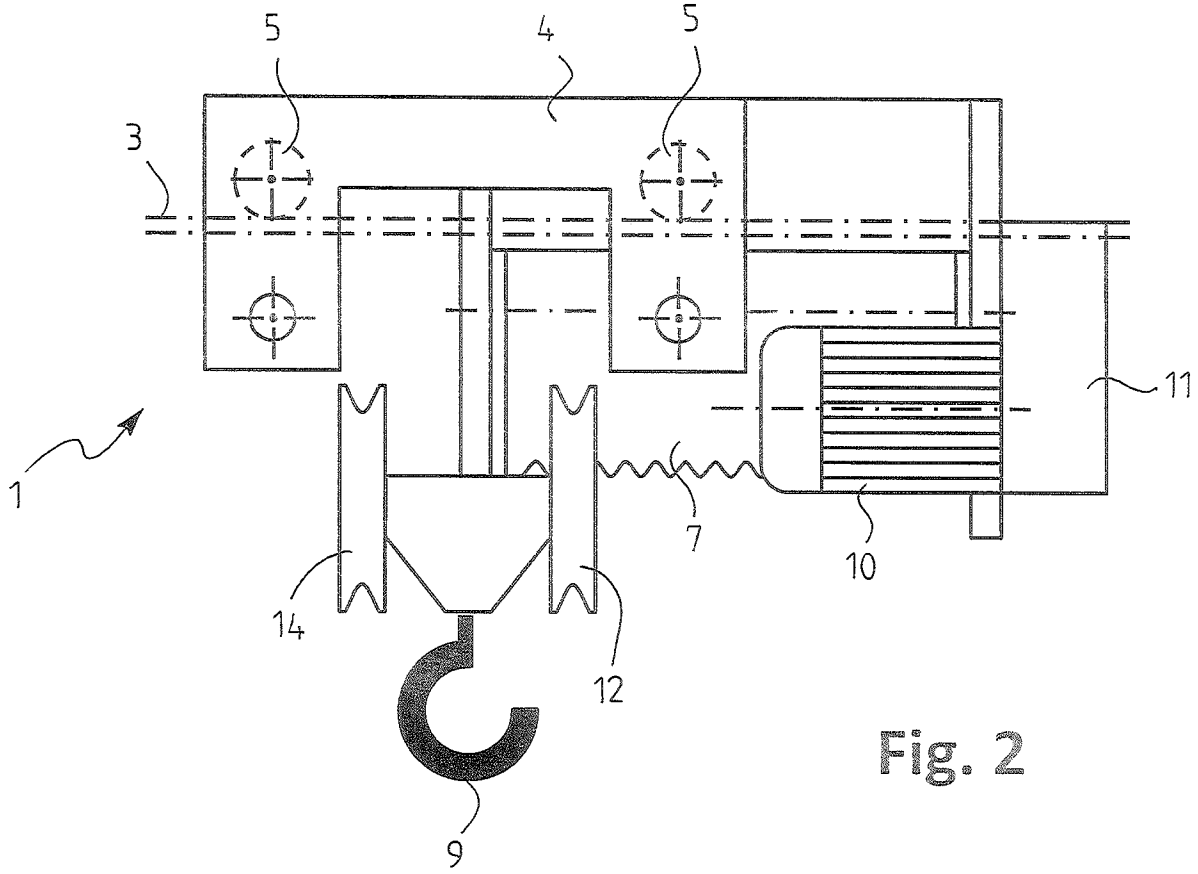
FIG. 2 is a side view of the trolley according to FIG. 1.
Figure 3:
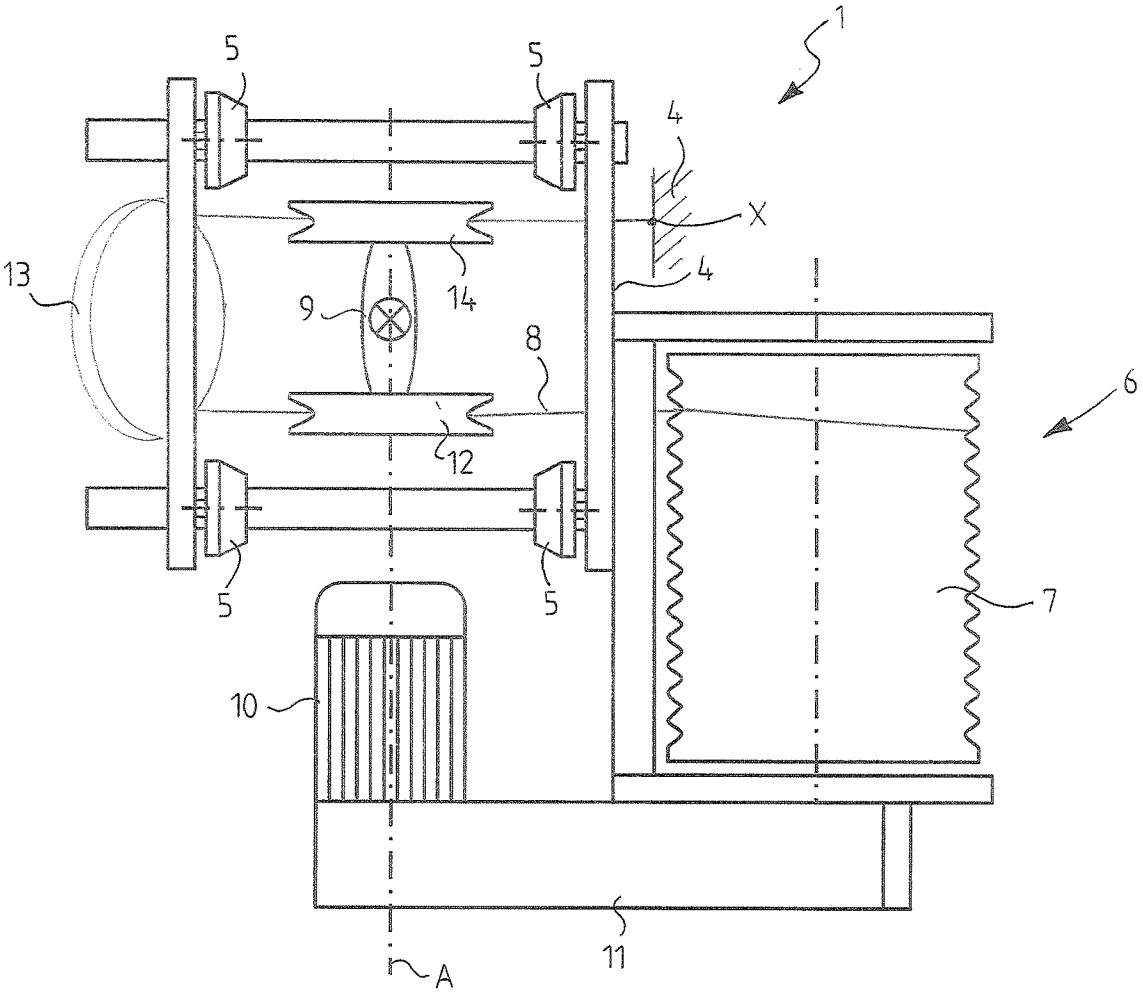
FIG. 3 is a trolley according to FIG. 1 as seen from the above.
Figure 10:
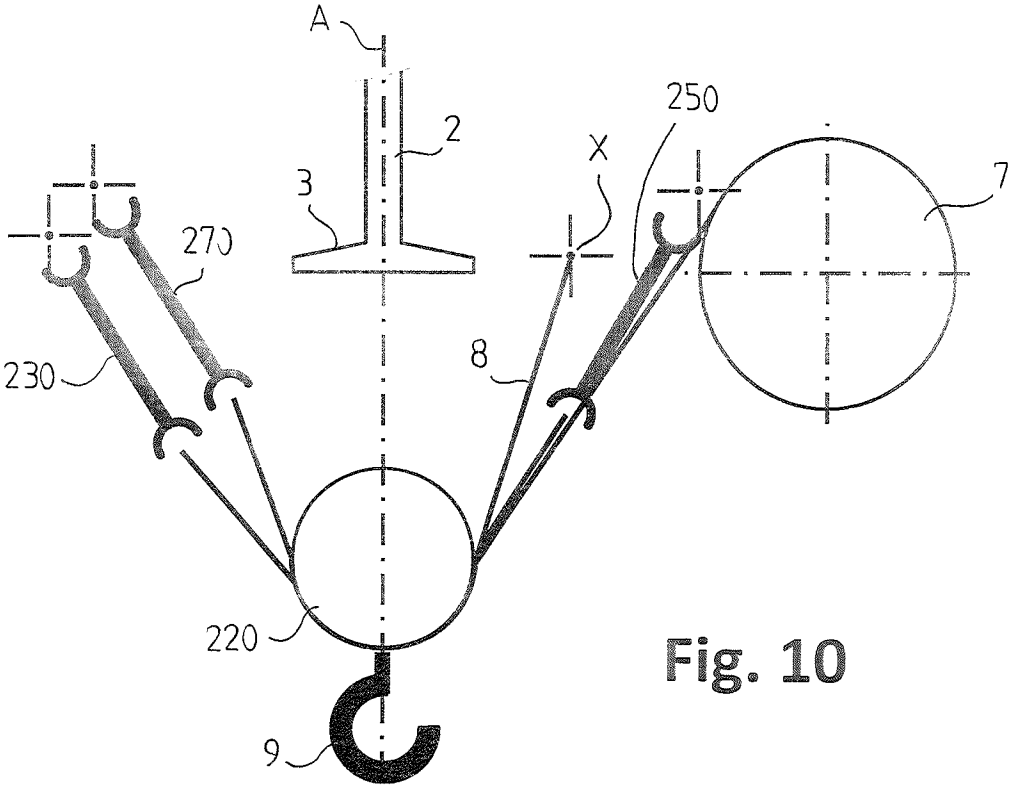
Figure 11:
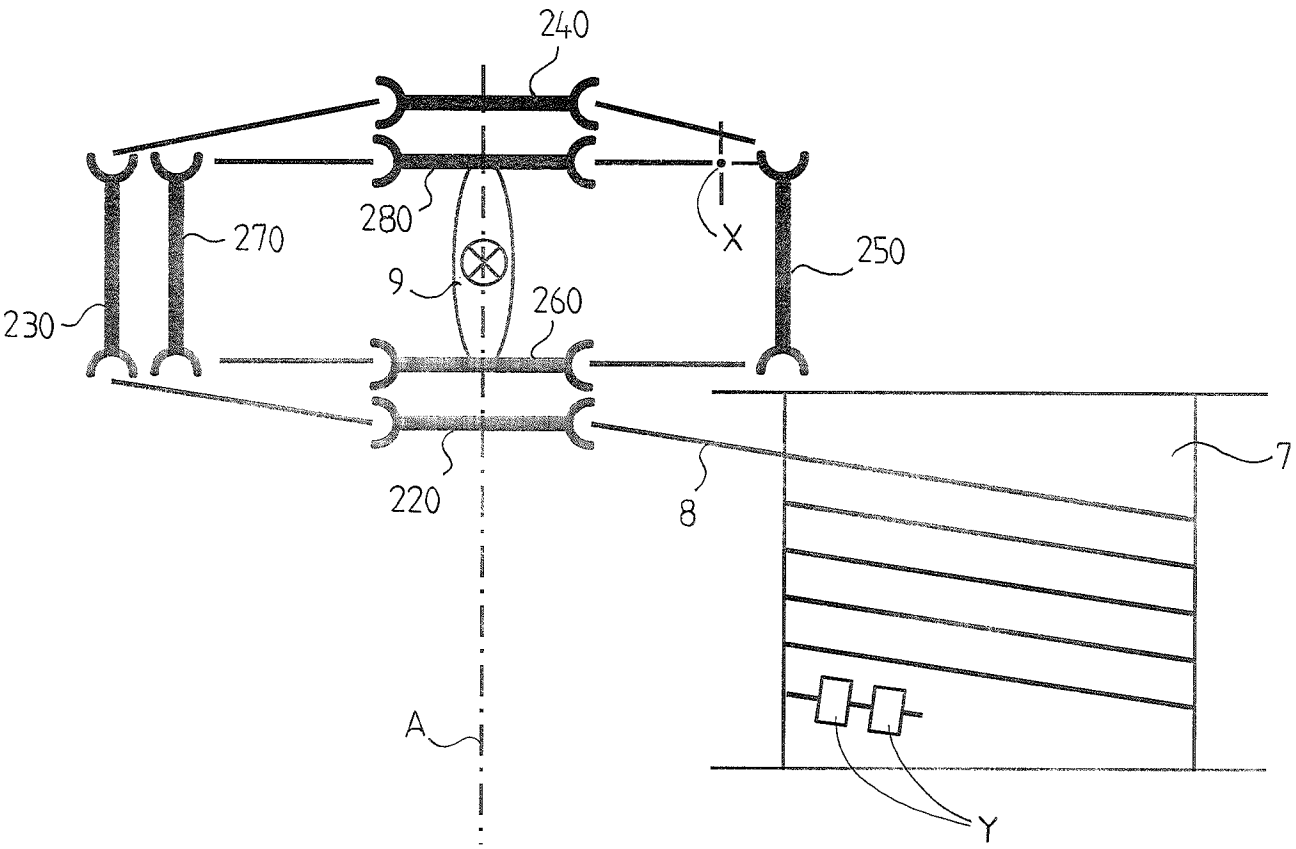

FIG. 10 is a side view of how an 8-rope hoisting rope travels in a structure modified as regards its rope system from the structure of FIGS. 1-3 when the hoisting member is almost at its upper position; and FIG. 11 is a top view of how an 8-rope hoisting rope travels in a structure modified as regards its rope system from the structure of FIGS. 1-3 when the hoisting member is at its upper position.

DETAILED DESCRIPTION OF THE INVENTION

Referring to the Figures, at first to FIGS. 1-3, in particular, a low-construction trolley 1 for a wire rope hoist is seen, arranged to travel along the lower flange 3 of a horizontal beam or of a rail 2, like here. The rail 2 typically establishes the main support of a bridge crane, or is included in it as its lowest part.

The trolley 1 is shown as a simplified functional diagram, showing only what is needed to understand the invention.

The trolley 1 comprises a frame 4 of the trolley, bearing wheels 5, and a hoisting mechanism 6.

The bearing wheels 5 are attached to the frame 4 of the trolley, and arranged to travel on the upper surface of the lower flange 3 of the rail 2, on both of its longitudinal edges, and at least some of are driven wheels to move the trolley 1.

The actuator (moving mechanism of the trolley) for driving the bearing wheels 5 is not shown.

The hoisting mechanism 6 comprises a rope drum 7 for a hoisting rope 8, a hoisting member in cooperation with the hoisting rope 8, i.e. a lifting hook 9 in this case, to hoist a load, a hoisting motor 10 to drive the rope drum 7, and a gear 11 to connect the hoisting motor 10 to the rope drum 7.

The rope drum 7 is fixed as supported by both of its ends to one side of the trolley frame 4, whereby the centre axis of the rope drum 7 is parallel to the rail 2, and the lifting hook 9 is arranged to travel under the rail 2, in the vertical plane A passing through the middle thereof.

In the conventional and common 4-rope driving of the hoisting rope 8 (see FIGS. 3-6, in particular), in which the hoisting rope is continuously subject to seven turns, the hoisting rope 8 is led from the rope drum 7 down to a first rope pulley 12 of the lifting hook 9, from there up to a sheave 13 on the other side of the trolley 1, further down from the sheave 13 to a second rope pulley 14 of the lifting hook 9, and finally up to the fixing point X on the frame 4 of the trolley 1 on the same side of the trolley 1 as the rope drum 7. The lifting hook 9 moves up or down depending on whether the hoisting rope 8 is reeled onto the rope drum 7 or out of it. The weight that the load creates is here distributed on four ropes.

Figure 8:
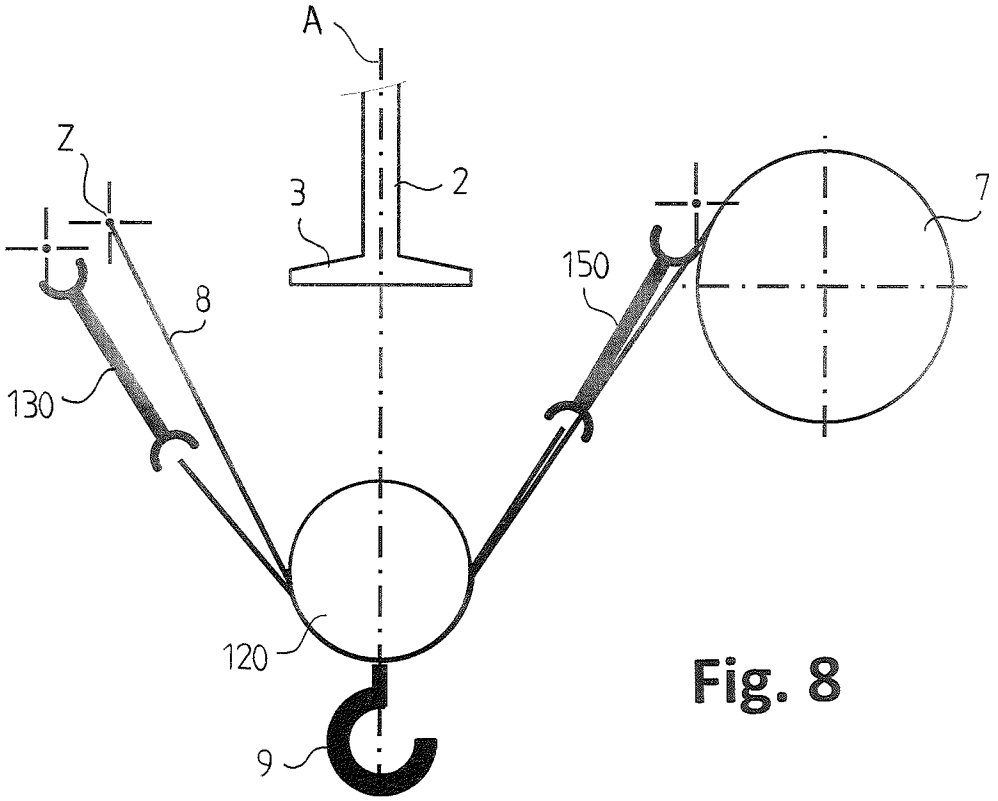
FIG. 8 is a side view of how a 6-rope hoisting rope travels in a structure modified as regards its rope system from the structure of FIGS. 1-3 when the hoisting member is almost at its upper position.
Figure 9:
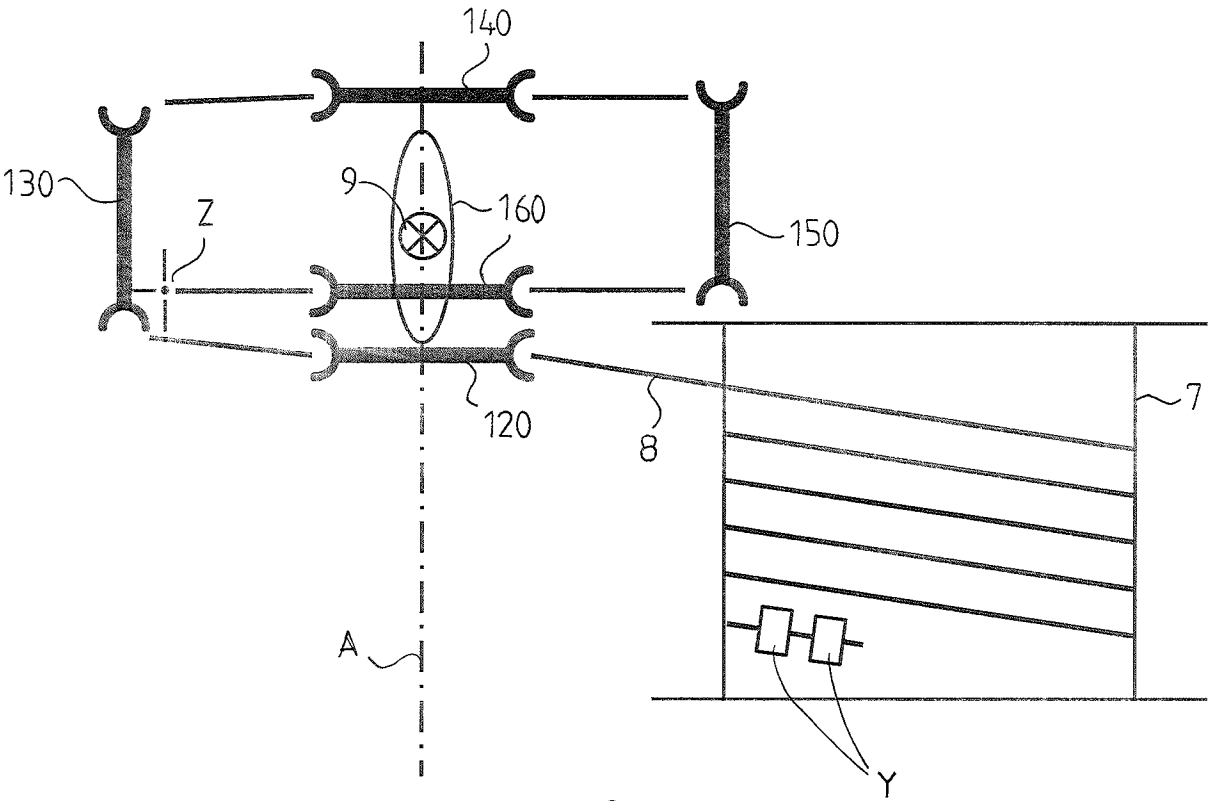
FIG. 9 is a top view of how a 6-rope hoisting rope travels in a structure modified as regards its rope system from the structure of FIGS. 1-3 when the hoisting member is at its upper position.

In the 6-rope driving of the hoisting rope 8 according to FIGS. 8 and 9, the hoisting rope 8 is led from the rope drum 7 down to a first rope pulley 120 of the lifting hook 9, from there up to a first sheave 130 on the other side of the trolley 1, further down from the sheave 130 to a second rope pulley 140 of the lifting hook 9, from there to a second sheave 150 on the first side of the trolley 1, from the sheave 150 back down to a third rope pulley 160 of the lifting hook 9, the rope pulley 160 being located closer to the vertical axis of the lifting hook 9 than the first rope pulley 120, and from there finally up to the fixing point Z on the frame 4 of the trolley 1 on the other side of the trolley 1 in relation to the rope drum 7.

In the 8-rope driving of the hoisting rope 8 according to FIGS. 10 and 11, the hoisting rope 8 is led from the rope drum 7 down to a first rope pulley 220 of the lifting hook 9, from there up to a first sheave 230 on the other side of the trolley 1, further down from the sheave 230 to a second rope pulley 240 of the lifting hook 9, from there to a second sheave 250 on the first side of the trolley 1, from the sheave 250 back down to a third rope pulley 260 of the lifting hook 9, the rope pulley 260 being located closer to the vertical axis of the lifting hook 9 than the first rope pulley 220, from there to a third sheave 270 on the other side of the trolley 1, the sheave 270 being closer to the vertical plane A passing through the rail 2 than the first sheave 230, from the sheave 270 down to a fourth rope pulley 280 of the lifting hook 9, the rope pulley 280 being closer to the vertical axis of the lifting hook 9 than the second rope pulley 240, and from here finally to the fixing point X on first side of the trolley 1 on the same side of the trolley as the rope drum 7.

It is essential for the trolley according to the present invention that the fixing point X; Z of the hoisting rope 8 to the frame 4 of the trolley is located in the longitudinal direction of the trolley 1 and rail 2 outside the end of the rope drum 7 (4-rope and 8-rope one of the presented examples), or outside the vertical plane which is transverse in relation to the rail 2 and passing through it (6-rope one of the presented examples), at a chosen distance from the end or the rope drum 7 or said plane. This distance is advantageously approximately 0-1.5 times the diameter of the rope drum 7.

In the most advantageous case, the fixing point X of the hoisting rope 8 to the trolley frame 4 is at essentially the same vertical plane as the disengagement point of the hoisting rope 8 from the rope drum 7, as seen in the line parallel to the axle of the rope drum 7 and rail 2.

Figure 5:
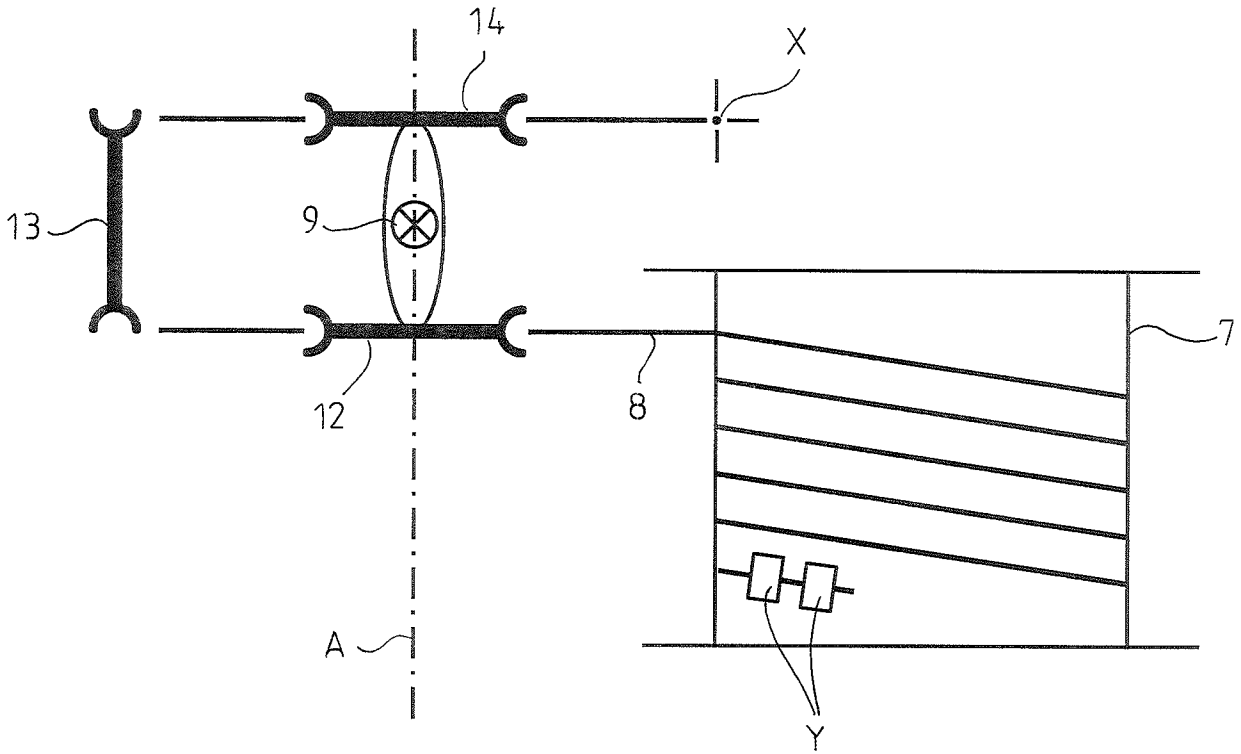
FIG. 5 is a top view of how a 4-rope hoisting rope travels in a structure according to FIGS. 1-3 when the hoisting member is at its upper position.
Figure 6:
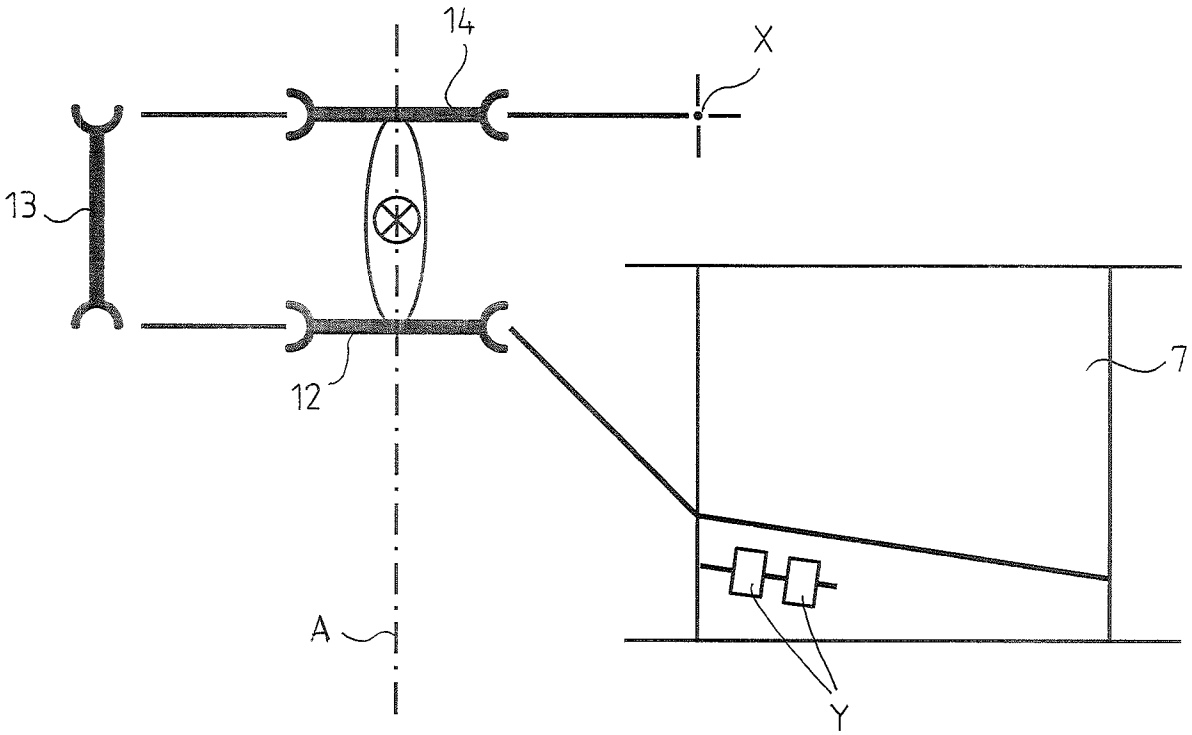
FIG. 6 is a top view of how a 4-rope hoisting rope travels in a structure according to FIGS. 1-3 when the hoisting member is at its upper position.

As shown in FIGS. 5 and 6 as well as 9 and 11, the fixing point Y of also the hoisting rope 8 to the rope drum 7 is located on that side of the rope drum 7 end which is on the opposite side than the rope drum 7 end outside of which, or outside the vertical plane which is transverse in relation to the rail 2 and passing through it, and closer to which the fixing point X; Z of the hoisting rope 8 to the trolley frame 4 is located.

Figure 4:
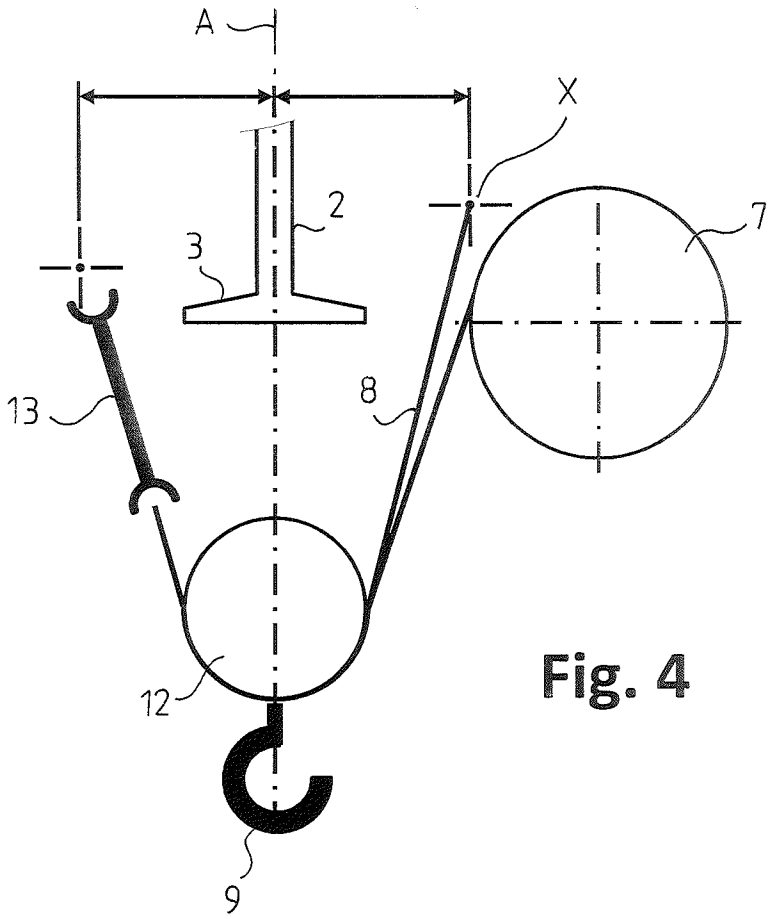
FIG. 4 is a side view of how a 4-rope hoisting rope travels in a structure according to FIGS. 1-3 when the hoisting member is almost at its upper position.

As shown in FIGS. 4, 8, and 10, the fixing point X; Z of the hoisting rope 8 to the frame 4 of the trolley is located at the chosen distance above the horizontal plane passing through the axle of the rope drum 7, advantageously at the same height as the disengagement point of the hoisting rope 8 from the rope drum 7 at the highest position of the lifting hook 9.

With the fixing of the hoisting rope 8 described in the above, in particular with its new fixing point X; Z to the frame 4 of the trolley, the twisting of the lifting hook 9 and the load secured to it and the resulting twisting stress on the trolley 1 is substantially reduced during the entire lifting event. Also, there is no danger of the hoisting rope 8 crossing at any phase of the hoist. This and advantages achieved by this were already described in closer detail in the above.

To achieve balance for the trolley 1, it is further advantageous for the invention that the hoisting motor 10 is placed under the beam or rail 2 and at least partly on a different side than the rope drum 7, in relation to the vertical plane passing through the contact lines of the bearing wheels 5 on the rope drum 7 side, touching the lower flange 3 of the beam or rail 2, most advantageously at least partly on a different side in relation to the vertical plane A passing through the middle of the rail 2 than the rope drum 7.

In the present example, the hoisting motor 10 is placed so that its longitudinal centre line is parallel to the longitudinal direction of the rail 2, and to be more precise, so that the hoisting motor 10 is placed at essentially the same vertical plane as the rail 2, whereby the vertical plane A passing in the middle of the rail 2 runs essentially through the longitudinal centre line of the hoisting motor 10. The sideward location of the hoisting motor 10 may, however, be changed as needed to achieve the desired balance.

In this example solution, the gear 11 that interconnects the hoisting motor 10 and the rope drum 7 is arranged so that the hoisting motor 10 and the rope drum 7 are on the same side in relation to the gear 11, whereby the hoisting motor 10, gear 11, and rope drum 7 are in a C form, as seen from the above. The hoisting motor 10 could also be located on the other side of the gear 11, in which case the hoisting motor 10, gear 11, and rope drum 7 would be in a Z form as seen from the above. The hoisting motor 10 could also be located transverse in the same line with the gear 11, in which case the hoisting motor 10, gear 11, and rope drum 7 would be in an L form as seen from the above.

Figure 7:
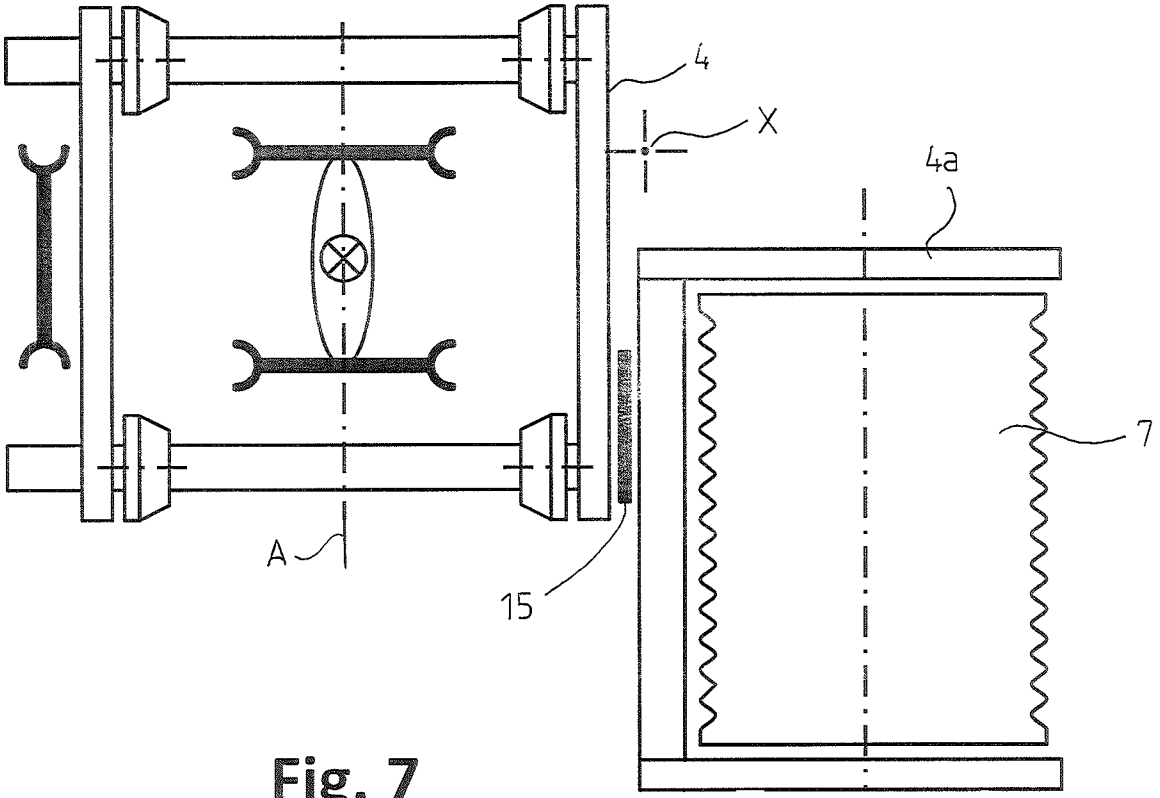
FIG. 7 shows, from the above, how a rope drum is secured by means of a separate connection piece to the trolley frame.

In the implementation example of FIG. 7, to further reduce stress, the rope drum 7 with its frame parts **4*a* and the hoisting motor (not shown) linked to the rope drum 7 and located at the desired place, are advantageously fixed to one corner of the trolley frame 4 by a separate joint 15, which is located closer to that end of the rope drum 7 from the side of which the hoisting rope 8 comes out when the lifting hook 9 is at its highest position. The location of the joint 15 is optimized so that the total torsional moment on the frame of the trolley 1 will be as small as possible. The total torsional moment consists of the combined effect by the bending moment and the torsional moment of the hoisting motor 10. The bending moment depends on the load and the disengagement point of the hoisting rope 8 as expressed in the longitudinal direction of the rope drum 7. The torsional moment depends on the moment of the hoisting motor 10** used for lifting. The purpose of optimizing the location of the joint is to avoid the situation where both the bending moment and the torsional moment are large at the same time, in which case the structure is under a particularly heavy load. Optimization seeks to achieve such a loading situation where, if one loading moment is big, the other moment would, on its part, be small. Such a comparison of the moments from the viewpoint of the structure optimum may be done, no matter which moment is big as long as the other one is similarly small.

The joint structure may be implemented, for example, so that the joint 15 is on both sides in contact with longitudinal stiffening members, which for their part connect to the rope drum 7 and trolley 1 at another location. In other words, the rope drum 7 has its own stiffening longitudinal stiffening member, such as a beam. This deviates from the prior art structure. This deviates from the prior art structure in that the rope drum 7 is conventionally fixed and braced to the side of a trolley. The hoisting rope 8 unreeling from the rope drum 7 and, consequently, rope force has affected the trolley at different moment arms and different directions, causing the trolley to twist. The twist has typically been evident in the trolley changing its shape, so that one of or some of the bearing wheels 5 rise out of the lower flange 3 of the rail 2. According to the invention, this rope force conveyed from the rope drum 7 through the hoisting rope 8 is first transferred to the structure surrounding the rope drum 7, which then connects to the trolley 1 by means of the joint 15.

The above description of the invention is only intended to illustrate the basic idea of the invention. A person skilled in the art may thus vary its details within the scope of the attached claims. So, there is no need for the hoisting motor, for example, to be located as presented in the above due to the rope system according to the invention, although that is advantageous. Therefore, in this invention, the hoisting motor may also be considered to be conventionally placed.

The invention claimed is:

1. A low-construction trolley for a wire rope hoist, arranged to travel along a lower flange of a horizontal beam or rail, the trolley comprising:

a trolley frame;

bearing wheels that are attached to the frame of the trolley and arranged to travel on an upper surface of the lower flange of the beam or rail, and at least some of which are driven wheels to move the trolley;

a hoisting mechanism comprising a rope drum for a hoisting rope, a hoisting member in cooperation with the hoisting rope for hoisting a load, and a hoisting motor for driving the rope drum;

wherein the rope drum is supported to a first side of the trolley frame so that the axle of the rope drum is parallel to the beam or rail, and the hoisting member is arranged to move under the beam or rail;

wherein the hoisting rope is led from the rope drum to a fixing point in the trolley frame through at least a rope pulley arrangement of the hoisting member, and wherein the fixing point of the hoisting rope to the trolley frame is located in the longitudinal direction of the trolley, respectively beam or rail, outside a longitudinal end of the rope drum.

2. The trolley as claimed in claim 1, wherein the fixing point of the hoisting rope to the trolley frame is located in the longitudinal direction of the trolley, respectively beam or rail, at a distance from the end of the rope drum.

3. The trolley as claimed in claim 1, wherein the distance of the fixing point from the end of the rope drum, or the vertical plane which is transverse in relation to the rail or beam and passing through the end, is approximately 0-1.5 times the diameter of the rope drum.

4. The trolley as claimed in claim 1, wherein the hoisting rope is led from the rope drum through the rope pulley arrangement of the hoisting member, and through at least one sheave on at least one side of the trolley frame to a fixing point in the trolley on the same side as the rope drum.

5. The trolley as claimed in claim 4, wherein the fixing point of the hoisting rope to the trolley frame is at a same vertical plane as a disengagement point of the hoisting rope from the rope drum, as seen in the line parallel to the axle of the rope drum and parallel to the rail.

6. The trolley as claimed in claim 1, wherein the hoisting rope is led from the rope drum through the rope pulley arrangement of the hoisting member, and through sheaves on both sides of the trolley frame to the fixing point in the trolley on the opposite side in relation to the rope drum.

7. The trolley as claimed in claim 1, wherein a second fixing point of the hoisting rope to the rope drum is located on a side of a rope drum end opposite of the longitudinal end of the rope drum closer to which the fixing point of the hoisting rope to the trolley frame is located.

8. The trolley as claimed in claim 1, wherein the fixing point of the hoisting rope to the frame of the trolley is located at a chosen distance above a horizontal plane passing through the axle of the rope drum, at the same height as the disengagement point of the hoisting rope from the rope drum at the highest position of the hoisting member.

9. The trolley as claimed in claim 1, wherein the hoisting motor is placed under the beam or rail and at least partly on a different side than the rope drum, in relation to the vertical plane passing through the contact lines of the bearing wheels on the rope drum side, touching the lower flange of the beam or rail.

10. The trolley as claimed in claim 9, wherein the hoisting motor is placed under the beam or rail and at least partly on a different side in relation to the vertical plane passing through the centre of the beam or rail than the rope drum.

11. The hoisting motor as claimed in claim 10, wherein the hoisting motor is placed at the same vertical plane as the beam or rail, whereby the vertical plane passing through the middle of the beam or rail is passing through the longitudinal centre line of the hoisting motor.

12. The trolley as claimed in claim 10, wherein the hoisting motor is placed so that a longitudinal centre line of the hoisting motor is parallel to the longitudinal direction of the rail or beam.

13. The trolley as claimed in claim 10, wherein the gear that interconnects the hoisting motor and the rope drum is arranged so that the hoisting motor and the rope drum are on the same side in relation to the gear, whereby the hoisting motor, gear, and rope drum are in a C form, as seen from the above.

14. The trolley as claimed in claim 9, wherein the hoisting motor is placed so that a longitudinal centre line of the hoisting motor is parallel to the longitudinal direction of the rail or beam.

15. The trolley as claimed in claim 9 wherein the gear that interconnects the hoisting motor and the rope drum is arranged so that the hoisting motor and the rope drum are on the same side in relation to the gear, whereby the hoisting motor, gear, and rope drum are in a C form, as seen from the above.

16. The trolley as claimed in claim 1, wherein the rope drum with frame parts of the rope drum and the hoisting motor linked to the rope drum and located at the desired place, are secured to one corner of the trolley frame by a separate joint, which is located closer to that end of the rope drum from the side of which the hoisting rope comes out when the hoisting member is at the highest position of the hoisting member.

17. The trolley as claimed in claim 16, wherein the joint is on both sides in contact with longitudinal stiffening members, which for their part connect to the rope drum and trolley at another location.

18. The trolley as claimed in claim 1, wherein the fixing point of the hoisting rope to the trolley frame is located in a position outside a space between two planes defined by longitudinal ends of the rope drum respectively, and beyond the longitudinal end of the rope drum that is closer to the hoisting member than the other longitudinal end of the rope drum, in a longitudinal direction of the rope drum.

* * * * *